United States Patent [19]

Stoddard

[11] Patent Number: 4,594,070

[45] Date of Patent: Jun. 10, 1986

[54] CALCULATOR FOR HARMONIZING COLORS

[76] Inventor: Elizabeth J. Stoddard, 267 Spyglass Dr., Eugene, Oreg. 97401

[21] Appl. No.: 613,435

[22] Filed: May 24, 1984

[51] Int. Cl.[4] ..... G09F 9/00; G09F 11/00

[52] U.S. Cl. ..... 434/104; 116/309

[58] Field of Search ..... 116/223, 309, 316, 318, 116/334, 335, DIG. 41; 40/113, 115; 434/98, 104; 235/78 R-78 RC, 88 R-88 RC; 356/421-424

[56] References Cited

U.S. PATENT DOCUMENTS

| | | | |
|---|---|---|---|
| 1,351,661 | 8/1920 | Kaufman | 434/104 |
| 1,483,529 | 2/1924 | Tanner | 434/104 |
| 1,762,036 | 6/1930 | Steedle | 434/104 |
| 2,238,316 | 4/1941 | Gaugler | 434/104 |
| 2,512,181 | 6/1950 | Spears | 434/104 |
| 4,112,594 | 9/1978 | Impastato | 434/104 |
| 4,199,877 | 4/1980 | Akiyama | 434/104 |

FOREIGN PATENT DOCUMENTS

| | | | |
|---|---|---|---|
| 322690 | 6/1957 | Switzerland | 116/309 |
| 1162252 | 8/1969 | United Kingdom | 40/113 |

*Primary Examiner*—Charles Frankfort
*Assistant Examiner*—W. Morris Worth
*Attorney, Agent, or Firm*—James D. Givnan, Jr.

[57] ABSTRACT

A hand held calculator including a base having basic colors displayed about its margin. A concentric rotatable member is divided into a multitude of different color sectors with each sector including a pure color, a shade thereof, a tone thereof and a tint thereof. A rotatable selection guide includes a pointer for selective positioning over a basic color on the base or over a pure color on the rotatable member, or both a basic and a pure color. The selection guide additionally defines windows and open end areas each of which being registerable with a color sector on the rotatable member. View ports defined by the selection guide each permit viewing of a tone and a tint of different color sectors. Indices on the base and rotatable member indicate incompatibility of certain colors, shades and tones.

5 Claims, 3 Drawing Figures

CALCULATOR FOR HARMONIZING COLORS

BACKGROUND OF THE INVENTION

The present invention pertains generally to color wheels which serve as aids to the selection of compatible colors for clothing, room interiors, cosmetics, etc.

The term color wheel encompasses numerous devices, usually hand held, which assist the user in the selection of two or more compatible colors. Known color wheels include the circular arrangement of colors on a base; the display of colors in sectors of a circle; the use of windows in a rotatable calculator member; and the use of pointer equipped wheels on a base.

A common shortcoming of known color wheels or the like is their complexity both in construction and in their use. Further, the color selection possible is limited to relatively few colors.

SUMMARY OF THE PRESENT INVENTION

The present invention is embodied in a hand held color calculator for use by those both skilled and unskilled in color selection.

The present calculator includes a base having areas about its annular margin each being of a different basic color. The calculator includes a rotatable member of circular shape smaller than the base and having pure color areas about its outer margin which contain those pure colors commonly found in clothing, paint, furnishings, cosmetics, etc. Said rotatable member is divided into sectors with each sector containing a pure color, a tone thereof, a shade thereof and a tint thereof.

A color selection guide concentrically overlies the calculator base and rotatable member. The guide is of novel configuration enabling the selection of a wide number of pure colors, shades, tints and tones.

Certain colored areas of the calculator are coded with indices to indicate incompatible colors. The guide has windows, open ended areas and view ports through which colors on underlying components are visible.

Important objectives of the present calculator include the provision of a calculator lending itself to convenient use by those unskilled in colors and color selection; the provision of a calculator providing a wide array of color selections to the user; the provision of a color calculator which clearly identifies incompatible colors.

DETAILED DESCRIPTION OF THE PREFERRED EMBODIMENT

Figure 1:
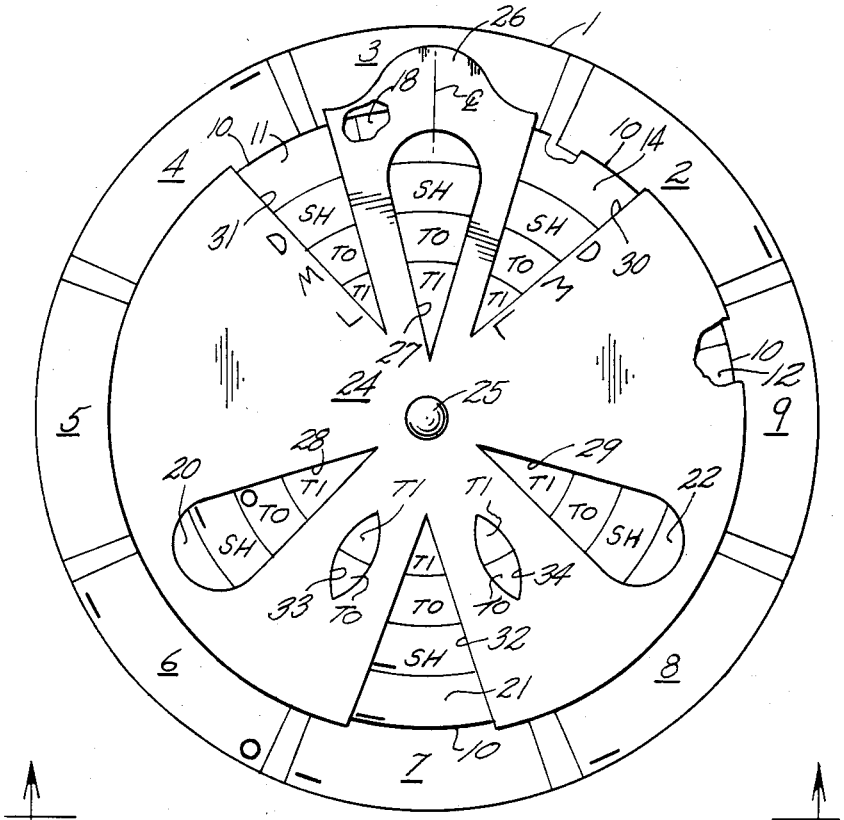
FIG. 1 is a plan view of the present calculator.
Figure 2:
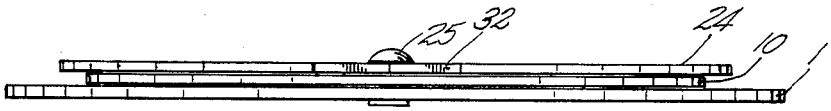
FIG. 2 is an elevational view taken along line 2—2 of FIG. 1.
Figure 3:
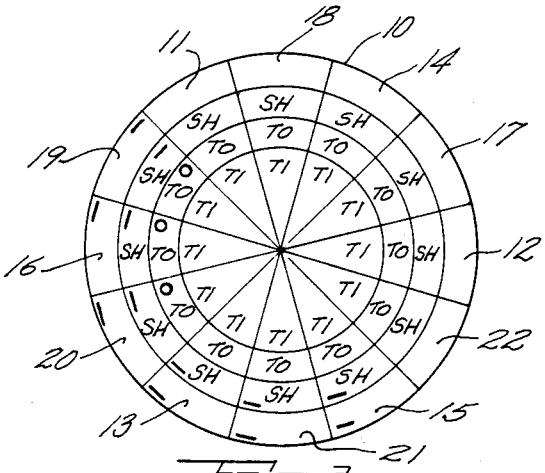
FIG. 3 is a plan view on a reduced scale of the rotatable member of the calculator.

With continuing reference to the drawing wherein applied reference numerals indicate parts hereinafter similarly identified, reference numeral 1 indicates a base of the calculator.

Disposed about an annular margin of base 1 are eight popular basic color areas; black 2; grey 3; navy blue 4; cream 5; dark brown 6; beige 7; dark green 8; and white 9.

A rotatable member 10 of the calculator is of circular shape and has an outer marginal area on which are displayed twelve pure or true color areas as follows; red area 11; yellow area 12; blue area 13; orange area 14; green area 15; violet area 16; yellow-orange area 17; red-orange area 18; red-violet area 19; blue-violet area 20; blue-green area 21 and yellow-green area 22. The foregoing color areas on the rotatable member are each in outermost separate sectors of a circle, hence the rotatable member has twelve color sectors. Additionally in each sector of rotatable member 10 is a shade at SH, a tone at TO, and a tint at TI of the sector pure or true color areas 11 through 22. The color sectors in the illustrated version each occupy thirty degrees.

A color selector guide at 24 is rotatable relative to base 1 by means of a pivot pin 25 also passing through base 1. Said guide has a pointer 26 which terminates outwardly over a basic color area on the base outer margin. In said pointer is a window area 27 while additional, equidistant (120 degrees) window areas 28–29 are defined by the remaining portion of the guide.

Open end view areas 30, 31 and 32 are also defined by the guide 24. Open areas 30 and 31 are medially offset thirty degrees to each side of a pointer centerline at CL. The remaining or third open end view area 32 is diametrically offset from the pointer centerline. The windows 27, 28, 29 and the open end view areas 30, 31 and 32 are of a size and shape to each register with an underlying sector on rotatable member 10. Said guide additionally defines viewing ports at 33 and 34 located on the guide oppositely adjacent open area 32 and medially spaced 60 degrees from each other. Said view ports permit viewing of a tone and a tint of two color sectors on rotatable member 10.

A system is provied to prevent the user from using two incompatible colors which system includes the providing of indices on certain basic colors on base 1. A dash (-) indices is on black area 2, blue area 4, brown area 6, beige area 7 and green area 8. Similarly, dash (-) indices are also on certain pure color areas and their shades on rotatable member 10 which indices serve to indicate those pure colors and shades thereof viewed through the windows and open areas which are imcompatible with basic colors also identified with a dash (-) indices. For example, red-violet area 19 and its shade area each bear a dash (-) as does green area 15 and its shade area.

A second set of indices in the above noted system are zeros (0) applied to one basic color, i.e., brown area 6 on base 1 and to several tone areas TO of several pure color sectors on rotatable member 10. Specifically the tone areas of the red-violet, violet and blue-violet sectors on rotatable member 10 are each identified with a zero (0).

In use, basic color on the margin of base 1 and/or a pure color on the outer margin of rotatable member 10 is selected. Pointer 26 is positioned over the color or colors you have chosen. Both a basic color on base 1 and a pure or true color on rotatable member 10 may be jointly located under pointer 26.

The windows 27, 28, 29 in guide 24 along with view ports 33–34 will now display underlying colors which coordinate with the basic or pure color (or both) beneath said pointer. Open area 32 will also display harmonizing colors, the colors displayed in open areas 30–31 are also harmonizing colors.

Exceptions to the foregoing instructions are:

Colors and shades identified with an indices such as a dash (-) match or harmonize only when next to one another as viewed through the open areas.

Those tones (TO) on rotatable member 10 identified with a zero (0) will not harmonize with the basic color on base 1 identified with a zero (0).

Those tones on the rotatable member 10 bearing the indices zero (0) will match or harmonize with other tones also bearing a zero (0).

It has been found advantageous to provide open end areas 30, 31 and 32 on rotatable member 10 for the reason that these areas permit comparison between side-by-side basic and pure colors without a visual barrier therebetween. Open areas 30 and 31 each have a medial radius disposed at thirty degrees included angle to the pointer centerline at CL. The open areas 30, 31 and 32 are circumferentially interposed between windows 27, 28, 29.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

I claim:

1. A calculator for selecting harmonizing colors, said calculator comprising, a base having a multitude of basic color areas spaced about a base margin, a rotatable circular member on said base and having differently colored sectors thereon defined by radii, each color sector of the rotatable circular member including an outer marginal area constituting a true color area and additional radially orientated areas of each sector being a shade, a tone and a tint of a true color in said true color area, a rotatable color selection guide on said circular member and including a pointer for disposition over a basic color on said base, said guide defining radially oriented windows through which true colors, shades, tones and tints of sectors on the rotatable circular member may be viewed and, certain of said basic color areas on the base and certain of said true color and shade areas on the rotatable circular member having indices thereon, said indices indicating color incompatibility between said basic color, true color and shade areas when said pointer is disposed over a basic color on said base identified with said indices and said true color and shade areas on the rotatable member visible through said windows are also identified with said indices.

2. The calculator claimed in claim 1 wherein said rotatable color selection guide additionally defines radially directed, open end areas through which sector shades, tones and tints may be viewed.

3. The calculator claimed in claim 2 wherein said rotatable color selection guide additionally defines view ports positionable over tones and tints of colored sectors of the rotatable member.

4. The calculator claimed in claim 2 wherein some of said open end areas in said selection guide are partially defined by said pointer.

5. The calculator claimed in claim 4 wherein said selection guide additionally defines view ports each positionable over a tone and a tint in separate color sectors of the base.

* * * * *